United States Patent [19]

Dörfler

[11] 4,385,221

[45] May 24, 1983

[54] ILLUMINATING DEVICE FOR A PUSH-BUTTON SWITCH

[75] Inventor: Erwin Dörfler, Neu-Isenburg, Fed. Rep. of Germany

[73] Assignee: VDO Adolf Schindling AG, Frankfurt am Main, Fed. Rep. of Germany

[21] Appl. No.: 261,073

[22] Filed: May 6, 1981

[30] Foreign Application Priority Data

May 19, 1980 [DE] Fed. Rep. of Germany ..... 3019021

[51] Int. Cl.[3] ..... H01H 9/16

[52] U.S. Cl. ..... 200/314; 200/310; 200/313

[58] Field of Search ..... 200/310, 311, 312, 314, 200/DIG. 47, 313

[56] References Cited

U.S. PATENT DOCUMENTS

| | | | |
|---|---|---|---|
| 2,437,555 | 3/1948 | Rees | 200/314 |
| 2,766,373 | 10/1956 | Gebel | 200/314 |
| 3,169,506 | 2/1965 | Morris | 200/314 |
| 3,377,452 | 4/1968 | Bock et al. | 200/314 |
| 3,584,174 | 6/1971 | Sprando | 200/314 |
| 3,780,248 | 12/1973 | Martin | 200/311 |
| 4,104,981 | 8/1978 | Ono et al. | 200/314 |
| 4,131,777 | 12/1978 | Bailey et al. | 200/311 |

FOREIGN PATENT DOCUMENTS

| | | | |
|---|---|---|---|
| 2049215 | 4/1972 | Fed. Rep. of Germany | 200/313 |

*Primary Examiner*—John W. Shepperd
*Attorney, Agent, or Firm*—Martin A. Farber

[57] ABSTRACT

A device for illuminating at least one hood-shaped push button, provided with a transparent surface, of a push-button switch having at least one source of light and having light-guide means acted on by the source. In the hood-shaped push button there is a light-conducting prism whose active illuminating surface is adjacent the light transparent area of the push button, two additional surfaces of the prism being coordinated to the source of light and formed such that the prism is illuminated by the source of light indirectly in one position of the push button and directly in the other position of the push button.

8 Claims, 4 Drawing Figures

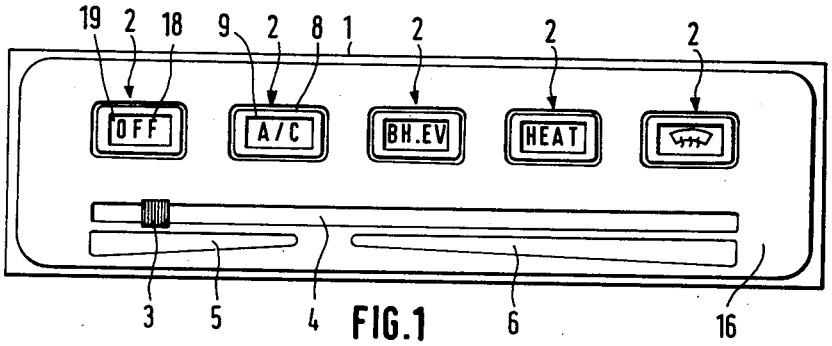
FIG.1
FIG.2
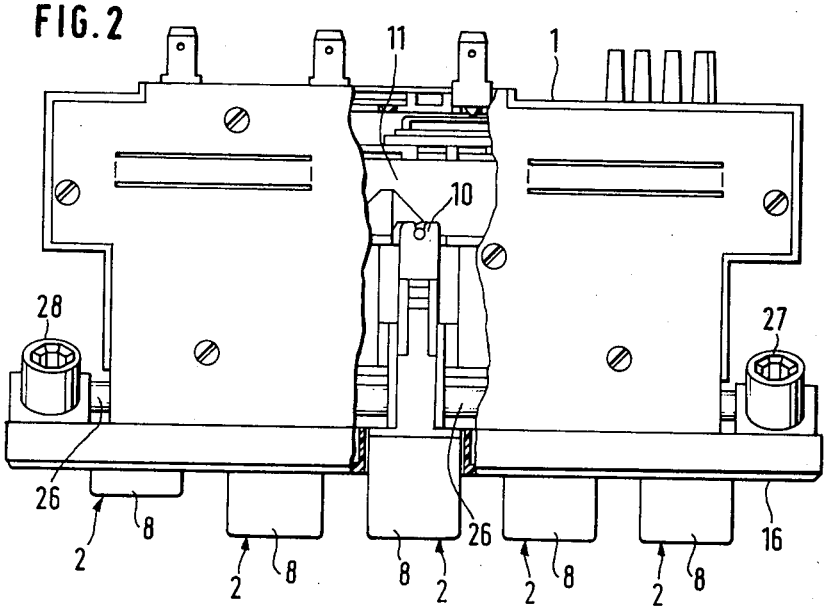

ILLUMINATING DEVICE FOR A PUSH-BUTTON SWITCH

The present invention relates to a device for illuminating the hood-shaped push button, provided with a transparent area of a push-button switch having at least one source of light and having light-guide means acted on by said source.

An illuminating device for a push-button switch is already known in which a converging lens is located in the rear portion of the push button, said lens focusing the light radiated by a source of light arranged in the fixed part of the push-button switch and projecting it against the transparent front surface of the push button. Depending on the position of the push button either only a part or all of the front surface is illuminated. In this way the person operating the switch can note whether the circuit of the switch is connected or disconnected. Such an illuminating device has the disadvantage that it is relatively expensive due to the use of a lens and the precise fastening thereof in the push button and that it is of a construction which is unfavorable from a manufacturing standpoint. Another considerable disadvantage is that the front surface of the push button which faces the observer is only partially illuminated at least in one of the two push-button positions so that the legibility of symbols arranged on the front surface during this position of switching of the push button leaves a lot to be desired.

These disadvantages are to be overcome by the present invention. The object of the invention, therefore, is to create an illuminating device for a push-button switch which has a structure which is both as simple as possible and as favorable as possible for manufacture and with which furthermore assurance is had that sufficient illumination for the rapid recognition of symbols located on the switch is present in every position of the push button.

This object is aided in accordance with the invention by providing in the hood-like push button (2) a light-conducting prism (20) whose active illuminating surface is adjacent the transparent area (9) of the push button (2), two additional surfaces (21,22) of said prism being associated with the source of light (23) and so developed that the prism (20) is illuminated by the source of light (23) indirectly in one position of the push button (2) and directly in the other position.

In this way the result is obtained that in every position of the push button the transparent surface thereof is completely illuminated and the instantaneous position of the push button is characterized by a difference in the intensity of the illumination. By the complete illumination of the transparent surface of the push button, rapid and dependable recognition of the symbols arranged in front of or behind the transparent surface is thus assured in every position of the push button. The manufacture and the mounting of the prism in the push button can be carried out extremely simply and without the use of any tools. No changes in position of the prism with respect to the transparent surface of the push button will, in contradistinction to the known illuminating devices, lead to any substantial change in the illuminating conditions on the transparent surface of the push button. This is particularly advantageous when several illuminated push-button switches are arranged closely alongside of each other and a uniform illumination of all push-button switches is desired for aesthetic reasons.

In accordance with the invention, the first of the two surfaces (21) lies on the longitudinal wall of the hood-shaped push button (2) which is adjacent the source of light (23), a light passage opening (24) being provided in the hood-shaped push button in the region of said surface. The second of the two surfaces (22) is the side of the prism (20) which is opposite the front side of the button and extends at an inclination to the first surface towards the source of light (23) and can be illuminated through another light-passage opening (25). This has the advantage of a construction which is extremely favorable from a manufacturing standpoint. Since the second surface which extends at an angle to the first surface towards the source of light acts as a light reflection surface in the position of the push button in which the light of the source of light enters into the prism through the light-passage opening arranged in the region of the first surface, it is advisable to arrange the second surface (22) at an angle of about 45° to the first surface (21).

In accordance with another aspect of the invention, in a device for illuminating several push buttons arranged alongside of each other there is advantageously provided as a source of light (23) a bar-shaped light guide (26) illuminated by at least one incandescent bulb, the light guide extending transversely to the direction of pushing of the push buttons (2). In this way a plurality of push buttons can be illuminated by a single incandescent bulb, which is possible only at increased expense if at all in the case of the known illuminating device.

For the proper illumination of the individual prisms in the case of an illuminating device which is developed for several push buttons it is advisable to provide the light guide (26), at least in the region of the individual push buttons (2), with reflection surfaces (29, 30) which are so shaped that approximately equal amounts of light per unit of surface emerge from the light guide at these places.

With the above and other objects and advantages in view, the present invention will become more clearly understood in connection with the detailed description of a preferred embodiment, when considered with the accompanying drawings, of which:

FIG. 1 is a front elevational view of a control device for an automobile air conditioning system;

FIG. 2 is a top view of the control device of FIG. 1 broken away in part;

Figure 3:
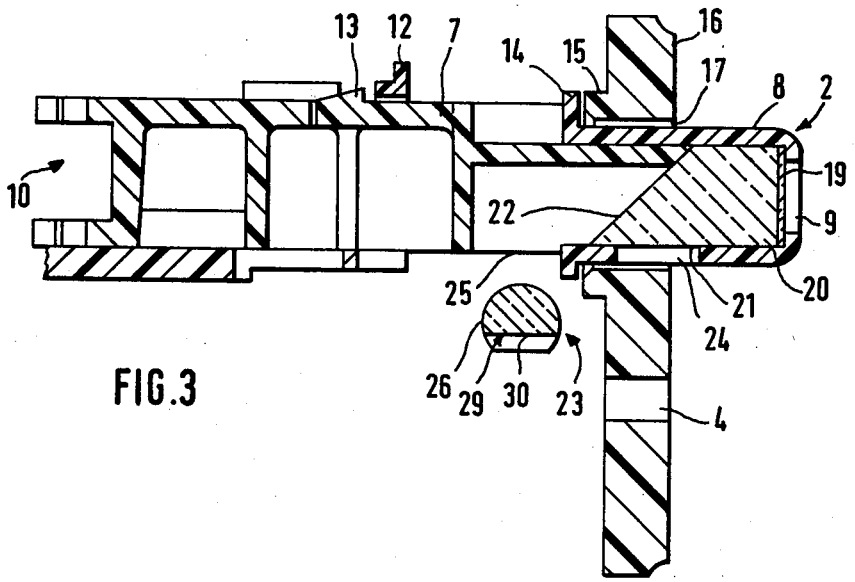
FIG. 3 is a longitudinal section through the control device of FIG. 1 through a push button showing parts important for the invention.
Figure 4:
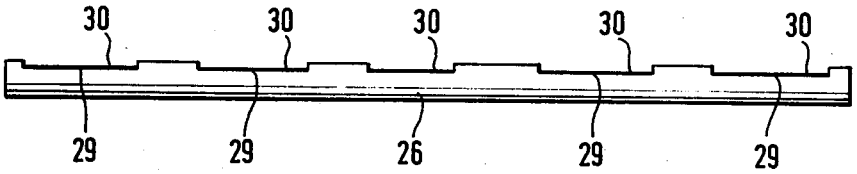
FIG. 4 is a side view of the light guide of the control device which illuminates the push buttons.

The air-conditioner control unit comprises a housing 1 containing five push-button switches 2 for different functions as well as a slider 3 which is movable along a cutout 4 and by means of which a continuous adjustment of the feeding of fresh air and the supply of heat into the inside of the vehicle is possible. Below the cutout 4 there are two differently colored imprints 5 and 6 which are intended to make it easier for the operator to set the desired inside temperature.

Each push-button switch 2 comprises a slide 7 which on its end facing the operator bears a hood 8 which has a passage opening 9 and is operatively connected at its other end 10 to the electric switch part. The electric switch parts of the five push-button switches are combined in a common housing 11.

The longitudinal movement of the slide 7 is limited by a stop 12 provided in the housing, the stop cooperating with a nose 13 present on the slide 7. An additional limiting is effected by the collar 14 formed on the hood 8, said collar cooperating with the extension 15 on the front side 16 of the housing. The collar 14 furthermore serves as light shield for the passage opening 17 of the hood 8 in the front part 16 of the housing.

For the illumination of the transparent disk 19 bearing symbols 18 arranged in the hood 8 behind the opening 9 a prism 20 is arranged closely behind the disk 19, the two surfaces 21 and 22 of said prism being coordinated with the source of light 23. In the wall of the hood which faces the side 21 there is a light-passage opening 24 through which light from the source of light 23 can penetrate into the prism 20 only when the hood 8 is in a depressed position. Another light-passage opening is present at the place 25 of the push-button. Through it light from the source of light 23 can penetrate, in the position shown in the drawing, via the surface 22 into the prism. By the inclined position of the surface 22 a part of the light irradiated by the source of light 23 is reflected by the surface 22 in the position of the push button shown in the drawing so that only a part of the light from the source of light 23 can enter into the prism 20. Accordingly, the disk 19 which is provided with the symbols 18 is only weakly illuminated. On the other hand if the push button is depressed, light from the source of light 23 can pass through the opening 24 into the prism, only a small part of the light which strikes the prism 20 being reflected. Furthermore, the light which has penetrated into the prism 20 is reflected on the oblique surface 22 in the direction towards the disk 19 so that the disk which bears the symbols 18 now is lit up substantially brighter than before. The operator can thereby note that the push-button switch is in the switched on position.

The source of light 23 comprises a light guide 26 which extends transversely to the direction of movement of the push buttons 2 and terminates at each of its two ends in a mount 27 and 28 respectively for an incandescent bulb. Within the region of each of the individual push buttons 2 the light guide 26 is provided with a reflection recess 29 which is arranged on the side of the light guide 26 facing away from the push button 2. The recess surfaces 29 are covered with a reflection layer 30 which may consist, for instance, of a white or other color.

While there has been disclosed an embodiment of the invention it is to be understood that this is given by example only and not in a limiting sense.

I claim:

1. In a device for illuminating at least one hood-shaped push button of a push-button switch having at least one source of light and having light-guide means acted on by the source, the push button having a transparent area, the improvement further comprising a light-conducting prism disposed in the hood-like push button, said light-conducting prism having:

an active illuminating surface adjacent to the transparent area of the push button, and two additional surfaces of said prism, a first of said two additional surfaces lies on a longitudinal wall of the hood-shaped push button adjacent the source of light, said hood-shaped push button defines a light-passage opening in a vicinity of said first additional surface, the latter being illuminable through said light-passage opening such that in one position of the push button said prism is directly illuminated by the source of light, said hood-shaped push button defines another light-passage opening, a second of said two additional surfaces constitutes a side of the prism opposite a front side of the push button and extends at an inclination relative to said first additional surface towards the source of light and is illuminable through said another light-passage opening in another position of the push button such that said prism is indirectly illuminated by the source of light.

2. The illuminating device as set forth in claim 1, wherein said second additional surface defines an angle of about 45 degrees relative to said first additional surface.

3. The illuminating device as set forth in claim 1, for illuminating several of the push buttons arranged alongside of each other, wherein said source of light constitutes a bar-shaped light guide extending transversely to the direction of pushing of the push buttons and at least one incandescent bulb means for illuminating said bar-shaped light guide.

4. The illuminating device as set forth in claim 3, wherein the light guide at least in a vicinity of the individual said push buttons, has reflection surfaces, respectively.

5. The illuminating device as set forth in claim 4, wherein said reflection surfaces are arranged in recesses formed on said light guide on a side of the latter facing away from said push buttons.

6. The illuminating device as set forth in claim 4, wherein said reflection surfaces are so shaped that substantially equal amounts of light per unit of surface emerge from the light guide at said reflection surfaces, respectively.

7. The illuminating device as set forth in claim 1, wherein said transparent area of the push button constitutes, said hood-shaped push button being formed with a front end opening, and a translucent disc is disposed in said push button adjacent to and covering said front end opening.

8. The illuminating device as set forth in claim 7, wherein said disc has symbols to be illuminated.

* * * * *